US005903939A

United States Patent [19]

Arft

[11] Patent Number: 5,903,939

[45] Date of Patent: May 18, 1999

[54] RAISED FRAME SUPPORT FOR SOFA-SLEEPER

[75] Inventor: Dennis E. Arft, Joplin, Mo.

[73] Assignee: L&P Property Management Company, South Gate, Calif.

[21] Appl. No.: 09/023,620

[22] Filed: Feb. 13, 1998

[51] Int. Cl.[6] ..... A47C 17/04

[52] U.S. Cl. ..... 5/13; 5/12.1; 5/226; 5/228

[58] Field of Search ..... 5/12.1, 13, 226, 5/228

[56] References Cited

U.S. PATENT DOCUMENTS

| | | | |
|---|---|---|---|
| 1,311,719 | 7/1919 | Simpson | 5/226 |
| 3,041,634 | 7/1962 | Willis . | |
| 3,247,526 | 4/1966 | Rogers, Jr. . | |
| 3,281,871 | 11/1966 | Katz . | |
| 3,431,567 | 3/1969 | Spitz et al. | 5/13 X |
| 3,654,642 | 4/1972 | Barabas . | |
| 3,952,344 | 4/1976 | Cycowicz et al. | 5/13 X |
| 4,253,205 | 3/1981 | Mikos . | |
| 4,571,755 | 2/1986 | Stevens . | |
| 4,752,976 | 6/1988 | Fanning . | |
| 4,754,505 | 7/1988 | Mizelle | 5/13 |
| 4,985,945 | 1/1991 | Robinson . | |
| 5,138,727 | 8/1992 | Hanes et al. . | |
| 5,257,424 | 11/1993 | Rogers . | |
| 5,414,871 | 5/1995 | Stevens | 5/13 |
| 5,539,940 | 7/1996 | Miller . | |
| 5,539,944 | 7/1996 | Miller . | |
| 5,642,536 | 7/1997 | Miller . | |
| 5,655,240 | 8/1997 | Miller . | |

FOREIGN PATENT DOCUMENTS

| | | | |
|---|---|---|---|
| 728910 | 4/1955 | United Kingdom | 5/228 |

*Primary Examiner*—Brian K. Green
*Assistant Examiner*—Fredrick Conley
*Attorney, Agent, or Firm*—Wood, Herron & Evans, L.L.P.

[57] ABSTRACT

A sofa sleeper foldable sofa bed assembly having pivotally interconnected head, body, intermediate and foot frame sections each including a pair of opposed side rails. The frame sections are extendable to form a bed and foldable to form a sofa seat. The frame is supported laterally by at least one generally U-shaped cross brace which is biased in an upwardly raised position by at least one resilient member.

18 Claims, 3 Drawing Sheets

RAISED FRAME SUPPORT FOR SOFA-SLEEPER

FIELD OF THE INVENTION

This invention relates to a combination sofa-sleeper bed, and, more particularly, to a sofa of the type which includes a foldable bed having a head, body, intermediate and foot sections which are foldable and may be collapsed and hidden inside a sofa frame when the unit is used as a seating surface.

BACKGROUND OF THE INVENTION

Sofa-sleepers generally comprise a four section foldable bed frame including pivotally interconnected head, body, intermediate and foot sections which are adapted to be folded between a fully folded or retracted position into a box-like sofa frame, and an extended position wherein the sections extend out and over the front rail of the sofa frame to form a bad. The head, body, intermediate and foot sections of the bed frame each include a pair of opposed side rails or members which are pivotally connected at their ends so that the sections are foldable or collapsible upon one another. The head and foot sections of the bed frame have end rails or members extending between the side rails. The side rails support a deck comprising a wire frame or link fabric or sheet of woven polypropylene or other plastic material over which a mattress is placed for sleeping. U.S. Pat. No. 4,752,976 issued to the assignee of the present application discloses a woven polypropylene fabric deck secured directly to the side rails of the bed frame. The bed frame is supported vertically when in an extended bed position by a plurality of foldable legs which fold or pivot into a collapsed position against the foldable bed frame when the bed frame is retracted.

When a user lies on a mattress supported by the bed frame in its extended position, a heavy load is placed on the deck, particularly in the area of the user's head and shoulders. This load exerts an inwardly directed force on the side rails of the head and body sections of the bed frame. This inwardly directed force tends to urge the side rails of the head and body sections towards each other, creating stress on the side rails and if great enough may even bend the side rails.

To alleviate such stresses, in prior art sofa beds, a lateral cross brace is typically connected between the side rails of the body section of the bed frame at a location where the chest and shoulders contact the deck. The cross brace is welded or riveted in a fixed position to the side rails in substantially the same horizontal plane as the upper surface of the bed frame, just beneath the deck and mattress of the sofa bed which are supported by the side rails of the bed frame. It has bean found that even with a relatively thick mattress the chest and shoulders are heavy enough to push downwardly and engage the cross brace when it is positioned just beneath the link fabric. Contact with the cross brace at the shoulders or chest is very uncomfortable and makes it difficult to obtain a restful night's sleep.

In order to avoid this problem, the lateral cross braces in some prior art sofa-sleepers have been formed with a crown or bow from end to end so that the middle portion of the cross brace is disposed approximately one inch below the deck secured to the side rails of the bed frame. This has proved to be unsatisfactory because cross braces with only about a one inch bow can still be felt by persons lying down on the deck when the sofa bed frame is extended.

In order to avoid contact of the chest and shoulders with a lateral cross brace, it is necessary to dispose the cross brace at least about three inches beneath the deck secured to the side rails of the bed frame. In accordance with the teachings of the prior art, however, it is not possible to design a sofa-sleeper bed with a cross brace having a three inch bow which is welded or riveted in a fixed position at each and to the side rails. This is because the foldable sections of the bed frame must be permitted to collapse in a compact unit for insertion within the box-like sofa frame of the sofa-sleeper. A fixed cross brace extending three or more inches below the deck secured to the side rails of the bed frame would not clear the front of the box-like sofa frame as the foldable bed frame sections are collapsed therein. Even if the sofa frame were designed to avoid interference with the lateral cross brace, it would contact the floor when the bed frame sections are collapsed into the sofa frame unless the sofa frame was raised a proportional distance from the floor. Raising the height of the sofa seat is not an acceptable design alternative since it must be low enough to permit persons of average height to touch the floor when seated.

U.S. Pat. No. 4,571,755 also issued to the assignee of the present application discloses a U-shaped cross brace which is pivotally mounted to the side rails of the body section of the bed frame. However, when the bed frame is extended, this cross brace is adapted to be disposed in a lowered position in which the bottom or transverse tube of the U-shaped cross brace is parallel to and approximately three inches below the horizontal plane defined by the bed frame. A complex linkage mechanism is required to pivot the U-shaped cross brace into a folded position in which the legs of the cross brace are substantially parallel to rather than transverse to the bed frame side rails so that the sofa sleeper frame may be placed into the sofa frame. The complex linkage mechanism required to fold the U-shaped cross brace into a folded position is expensive and increases the cost of the sofa sleeper.

Therefore, it has been one objective of the present invention to provide a sofa sleeper foldable sofa bed assembly having at least one U-shaped cross brace which may be raised quickly and easily without the assistance of a complex linkage mechanism.

It has been a further objective of the present invention to provide a sofa sleeper foldable sofa bed assembly having at least one U-shaped cross brace which is biased in a raised position so as to enable the sofa bed assembly to be folded into a sofa frame quickly and easily.

SUMMARY OF THE INVENTION

The invention of this application which accomplishes these objectives comprises a sofa sleeper foldable sofa bed assembly having pivotally interconnected head, body, intermediate and foot frame sections. Each section comprises a pair of opposed side rails. The head and foot frame sections each have an and rail connecting the opposed side rails. The frame sections extend outwardly to form a bed and are foldable to form a sofa seat. The frame sections may be folded into a stationary wooden sofa frame to form part of a seating surface of a sofa.

The sofa bed assembly further comprises at least one generally U-shaped cross tube. Each generally U-shaped cross tube has two opposed legs interconnected by a connecting segment at a first end of each leg. Each leg is pivotally connected at a second end of the leg to one of the side rails of the frame sections. The generally U-shaped cross tubes are typically pivotally connected to the side rails of the body frame section but may be pivotally connected to the side rails of any frame section.

The generally U-shaped cross brace and particularly the connecting section of the cross brace is biased into a raised position by at least one resilient member. When the generally U-shaped cross brace is in its raised position, the legs of the cross brace extend generally parallel the side rails of the frame sections. The first ends of the legs of the cross brace are movable against the bias of the at least resilient member away from the side rails.

In one embodiment of the present invention, two generally U-shaped cross braces are pivotally secured to the side rails of the body section of the bed frame. Each generally U-shaped cross brace is pivoted and held upwardly in a raised position by a pair of resilient members. In this embodiment, the resilient members are springs. However, the resilient members may be any other type of resilient structure such as elastic straps. Each resilient member has two opposed ends and is secured at one of the opposed ends to a side rail of the body section of the bed frame. The other and of each resilient member is secured to either one of the legs or the connecting section of the generally U-shaped cross brace. The two cross braces are biased upwardly towards one another by the resilient members and may be pushed downwardly to a second lower position if a downwardly directed force is exerted upon the connecting sections of the generally U-shaped cross braces. Such a downwardly exerted force would be exerted, for example, if one were to sit or Day down on the deck of the bed when the frame sections were extended.

In another embodiment of the present invention, resilient members extend between the generally U-shaped cross braces themselves. These resilient members are not attached to the side rails of the bed frame. Rather, each resilient member has two opposed ends, each end being secured to one of a pair of generally U-shaped cross braces. As in the first embodiment, a pair of generally U-shaped cross braces are pivotally secured to the side rails of the body section of the frame. In one of the embodiments of the present invention, a pair of resilient members are used to bias the pair of generally U-shaped cross braces into a raised position. One end of each resilient member is secured to one corner of one of the generally U-shaped cross braces and the other end of the resilient member is secured to the opposite corner of the other generally U-shaped cross brace. Configured in such a fashion, the resilient members form an "X"-shaped pattern. The pair of resilient members bias the connecting sections of the pair of generally U-shaped cross braces towards one another and are elastic enough so that when a downwardly directed force is exerted on the connecting sections of the generally U-shaped cross braces they may pivot downwardly away from the side rails of the body frame section.

Another embodiment of the present invention incorporates at least one sinuous wire extending between the connecting sections of the pair of generally U-shaped cross braces. Each sinuous wire extends longitudinally from one cross brace to the other cross brace. If multiple sinuous wires are used, they are transversely spaced apart from one another. The sinuous wires accomplish the same function as the X-shaped pair of resilient members described hereinabove in that they bias the U-shaped cross braces to an upwardly raised position in which the legs of the cross brace extend generally parallel the side rails of the body frame section.

A single elastic strap may be used as well to bias a pair of generally U-shaped cross braces into a raised position. The elastic strap has two opposed ends, each end being secured to one of the connecting sections of one of the generally U-shaped cross braces. Additionally, multiple elastic straps may be used.

Another embodiment of the present invention utilizes only one generally U-shaped cross brace rather than a pair of generally U-shaped cross braces. The generally U-shaped cross brace may be secured to the side rails of any section but is most often secured to the side rails of the body frame section. A pair of resilient members which may be wires, rope or any other elastic member capable of elongating are utilized to bias the generally U-shaped cross brace into a raised position. One end of each resilient member is secured to the connecting section of the cross brace and the other end of the resilient member is secured to a side rail of the intermediate frame section. The resilient members form an "X"-shaped pattern.

Whether one generally U-shaped cross brace or multiple generally U-shaped cross braces are used to stabilize the side rails of the body frame section, at least one resilient member is used to urge each cross brace into a raised position so that the sofa bed assembly may be easily folded into a sofa frame These and other objects and advantages of the present invention will become more apparent from the following drawings.

DETAILED DESCRIPTION OF THE DRAWINGS

Figure 1:
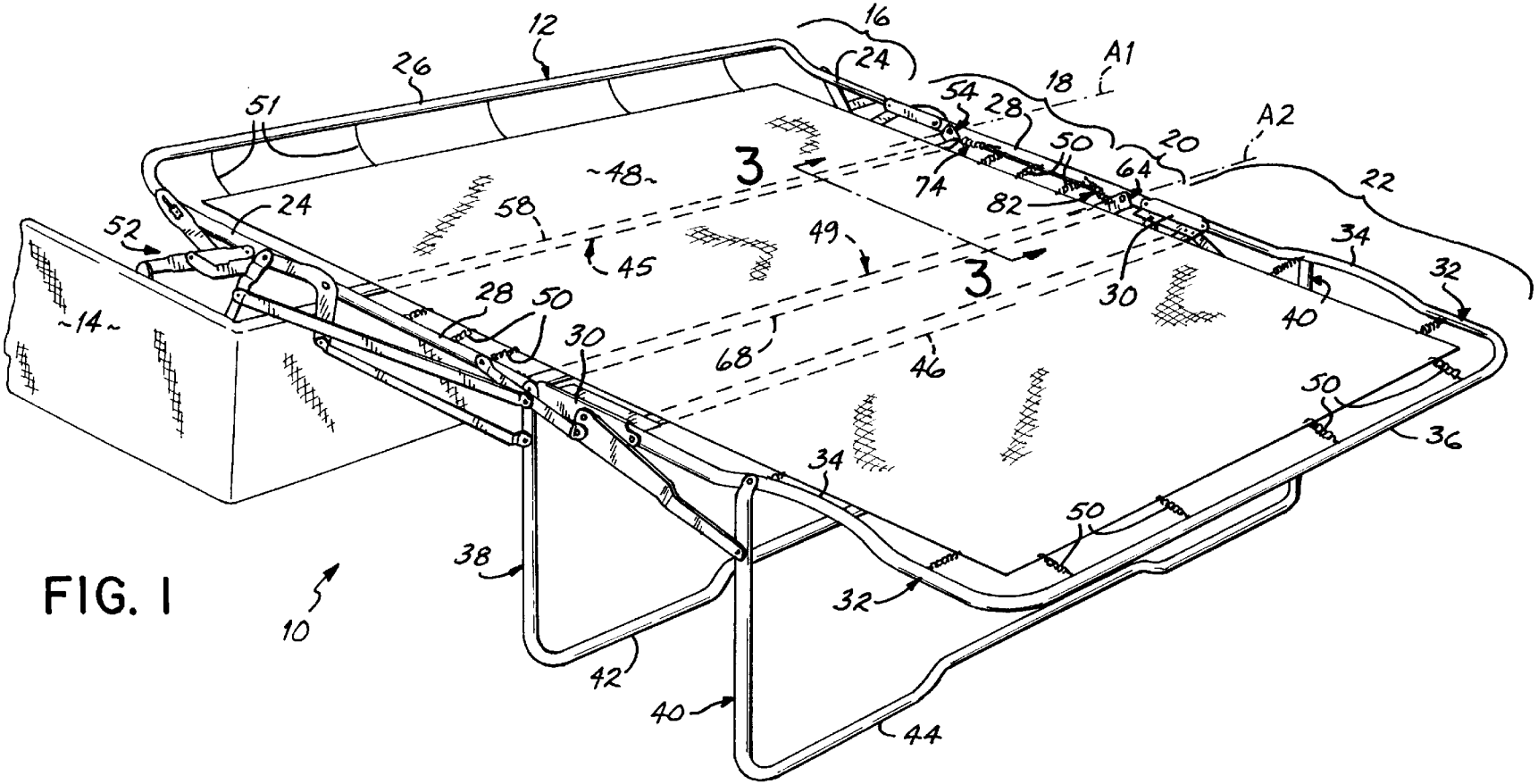
FIG. 1 is a perspective view of the sofa bed assembly of the present invention extended outwardly in the bed position.

Referring to the drawings and particularly to FIG. 1, there is illustrated a sofa sleeper assembly 10 of the present invention including a foldable sofa sleeper frame 12 mounted upon a conventional sofa frame 1 4. The sofa frame 14 which may be wooden or made of any other material does not form part of the invention of this application and comprises any well known standard frame. The connection between the sofa sleeper assembly 10 and the sofa frame 14 may be any conventional mechanism and again does not form part of the invention of this application. For purposes of this application, the terms front and forward end of the bed references that direction which is toward the front end of the unfolded bed (to the right in FIG. 1) while the terms rear or rearward as used in this application refer to the direction which is toward the head end of the unfolded bed or to the left as seen in FIG. 1.

The foldable sofa sleeper frame 12 comprises a rear head section 16, a body supporting section 18 pivotally connected at one end to the head section 16, a short intermediate section 20 pivotally connected at one and to the other end of the body section 18, and a front foot section 22 pivotally connected at the other end of the intermediate section 20. The head section 16 comprises similarly symmetrical disposed left and right side rails 24 which are connected with a rear end rail 26. The body section 18, the intermediate section 20 and the foot section 22 each comprise similarly disposed left and right side rails 28, 30, and 32 respectively. Side rails 32 of the foot frame section 22 are illustrated as having an arcuate portion 34 which curves upwardly when the assembly is in the bed position with the frame sections extended. An end rail 36 connects the opposed side rails 32 of the foot frame section 22 and serves as the frontmost edge of the frame 12 of the sofa bed assembly 10 when the assembly is in the extended bed position.

The end rails 26, 36 and side rails 24, 28 and 32 of the head, body and foot sections respectively are illustrated as being circular in cross section. Similarly, side rails 30 of intermediate section 20 are illustrated as having an L-shaped cross-sectional configuration. This application does not intend to limit the configuration of any of these side or end rails. It is therefore within the scope of this patent application to have the side and and rails of the frame sections be of a circular, rectangular, L-shaped square cross sectional configuration or any other configuration not specifically listed.

The pivotally connected bed frame sections 16, 18, 20 and 22 are supported in their extended position by a pair of foldable center support legs 38 pivotally connected at their upper ends to the back end of the side rails 30 of the intermediate frame section 20 and a pair of foot section supporting legs 40 pivotally connected at their upper ends to the side rails 32 of the foot frame section 22. The legs 38 are connected by a first bottom bar 42 and legs 40 are interconnected by a second bottom bar 44 respectively. Both the first and second bottom bars 42, 44 rest on the floor when the frame sections are extended and the sofa bed assembly is in its extended bad position. When the frame sections are folded into the sofa or retracted position, legs 40 and bottom bar 44 pivot forwardly and legs 38 and bottom bar 42 pivot rearwardly in order to enable the frame sections to fold into the sofa position.

Figure 2:
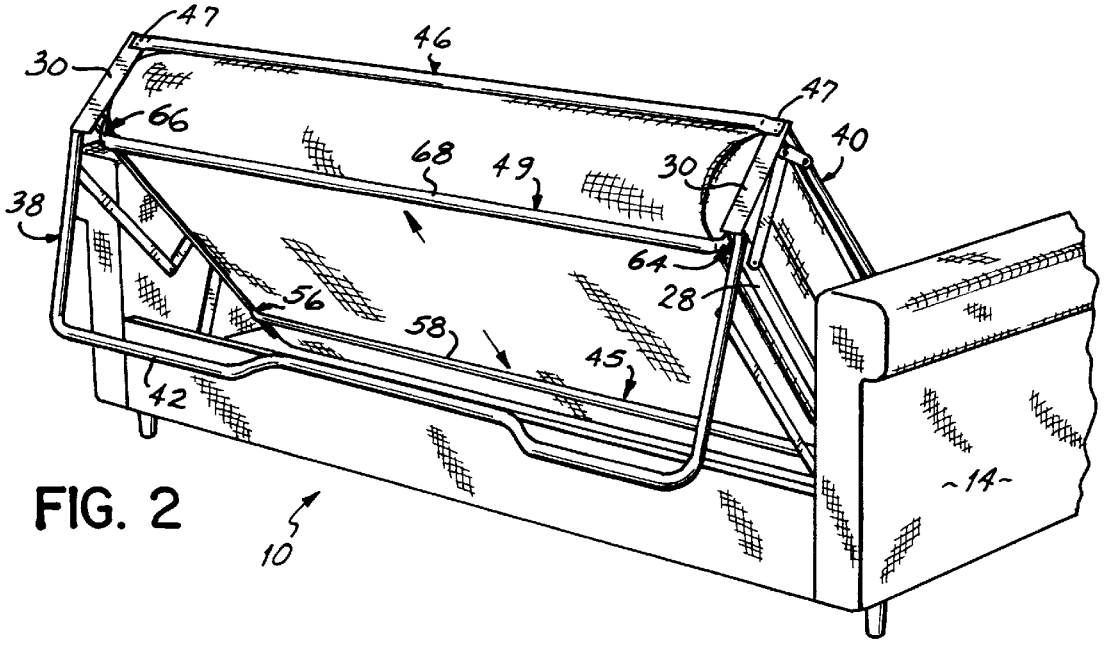
FIG. 2 is a perspective view of the sofa bed assembly of FIG. 1 collapsed in a retracted position inside the frame of a sofa.

A cross rail 46 extends between the opposed side rails 30 of the intermediate frame section 20 at the forward edge of the intermediate frame section side members or rails 30. The cross rail 46 is generally parallel the end rails 26 and 36 respectively and has flattened ends 47 as best illustrated in FIGS. 1 and 2. Between the flattened ends 47 of the cross rail 46, the cross rail is generally bulbous in cross section but may be of any shape. Similarly, a pair of cross braces 45, 49 may extend between the opposed side rails 28 of the body supporting section 18 of the frame in order to provide additional support for a person lying on the bed when the frame sections are extended. Although two cross braces 45, 49 are illustrated, any number including only one cross brace may extend between the opposed side rails 28 of the body supporting section 18 of the frame.

The opposed side rails 24, 28, 30, 32 of the head, body supporting, intermediate and foot sections 15, 18, 20, 22 form a rigid bed frame when extended as illustrated in FIG. I and a rigid seating frame when retracted as partially shown in FIG. 2. A continuous section of fabric material 48 or a sheet of woven polypropylene or other similar plastic material is resiliently connected to the side frame members 24, 28, 30, 32 of frame sections 16, 18, 20 and 22 by coil springs 50 to provide a mattress supporting surface or deck for seating and sleeping. The continuous section of fabric material 48 is illustrated as extending substantially the entire length of the frame but alternatively, the fabric material 48 may only extend from the head section 16 to the intermediate frame section 20 with coil springs 50 securing fabric material 48 to the side frame members 24, 28 and 30 and to the cross rail 46 rather than the front and rail 36. Arcuate wires 51 are shown as fixedly securing fabric material 48 to end rail 26 but coil springs 50 may be used as well. Alternatively, any other type of material such as a wire grid may extend from proximate the rear end rail 26 to proximate the cross rail 46 and be secured to the rear end rail 26, cross rail 46 and side rails 24, 28 of the head and body frame sections by any number of known methods.

In order to support the sofa sleeper frame 12 for controlled collapsing movement into the sofa frame 14, there is a linkage system, generally designated by the numeral 52, which extends between and interconnects the sofa frame 14 and the foldable sofa sleeper frame 12. This linkage system 52 per so forms no part of the invention of this application and therefore has not been described in detail herein. A complete description of one such linkage system suitable for use in the practice of this invention is completely described in the assigneses own U.S. Pat. No. 4,253,205, the disclosure of which is incorporated by reference herein. This linkage system 52 not only controls the folding of the foldable sofa sleeper frame 12 and legs 38, 40 into the storage enclosure of the wooden sofa frame 14, but also controls the unfolding of the frame 12 and supporting legs 38, 40 when the sofa is converted from an item of seating furniture, i.e. a sofa, into an item of sleeping furniture, i.e. a bed.

Figure 3:
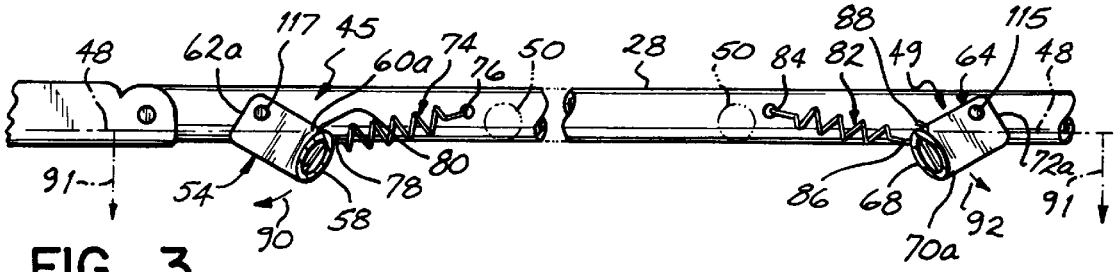
FIG. 3 is a view taken along the lines 3—3 of FIG. 1.

As best illustrated in FIGS. 1 and 3, cross braces 45, 49 are pivotally secured to side rails 28 of body frame section 18, the cross brace 45 being spaced a sufficient distance toward the rear end of the frame from cross brace 49. Generally U-shaped cross brace 45 is pivotable about a transversely extending axis A1. Similarly, generally U-shaped cross brace 49 is pivotable about a transversely extending axis A2, the axes A1 and A2 being generally parallel.

Generally U-shaped cross brace 45 has a first leg 54, a second leg 56 and a connecting section 58. As best illustrated in FIG. 3, legs 54, 56 each have a first end 60 and a second end 62, the first ends 60 being connected by the connecting sect-on 58. The second end 62 of each leg 54, 56 is pivotally connected to one of the side rails of the body frame section 28. For the sake of simplicity, the part members of leg 54 will have an "a" suffix and the part members of leg 56 will have a "b" suffix.

Similarly, generally U-shaped cross brace 49 has a first leg 64 and a second leg 66, the legs 64 and 66 being connected by a connecting section 68 (see FIG. 2). For the sake of simplicity, the part numbers of leg 64 will have an "a" suffix and the part numbers of leg 66 will have a "b" suffix. As illustrated in FIG. 3, each of the first and second legs 64, 66 of generally U-shaped cross brace 49 has a first end 70*a*, 70*b*. The first ends 70*a*, 70*b* of legs 64, 66 are connected by the connecting section 68. Leg 64 has a second end 72*a* and leg 66 has a second end 72*b*. The second ends 72*a*, 72*b*of the legs 64, 66 are pivotally secured to the side rails 28 of the body frame section 18.

The second ends 72*a*, 72*b* of legs 64, 66 of generally U-shaped cross brace 49 are pivotally secured to the side rails 28 of the body frame section 18 by fasteners 115. The fasteners 115 are located in the transversely extending axis A2. Similarly, legs 54, 56 are pivotally secured at their second ends 62*a*, 62*b* to the side rails 28 of the body frame section 18 by fasteners 117, fasteners 117 defining the axis A1. Fasteners 115, 117 may be rivets, pins or any other mechanism which secures the generally U-shaped cross braces 45, 49 to the side rails of any of the frame sections.

As best illustrated in FIG. 3, at least one resilient member 74 holds the generally U-shaped cross brace 45 in a raised position. One resilient member 74 may be sufficient to hold generally U-shaped cross brace 45 in a raised position. However, most often a pair of resilient members 74 are used to hold the generally U-shaped cross brace 45 in a raised position. The resilient member 74 has a first end 76 and a second end 78. The first end 76 of resilient member 74 is fixedly secured to the side rail 28 of the body frame section 18. The second end 78 of resilient member 74 is secured to the generally U-shaped cross brace 45, either to one of the legs 54, 56 or the connection section 58 of the generally U-shaped cross brace 45. The first end 76 of the resilient member 74 may be secured to the side rails 28 of the body frame section 18 by any means such as being tied to-a bolt extending outwardly from the side rails 28. Similarly, the second end 78 of the resilient member 74, although illustrated as having a hook 80 passing through a hole in the connecting section 58 of the generally U-shaped cross brace 45, may be secured to the cross brace 45 by any other conventional mechanism.

The second generally U-shaped cross brace 49 is held in an upwardly raised position by at least one resilient member 82. Each resilient member 82 has a first end 84 and a second end 86. The first end 84 is secured to a side rail 28 of the body frame section 18, The second end 86 is secured via a hook 88 to either the connecting section 68 or one of the legs 64, 66 of the generally U-shaped cross brace 49. Although hook 88 is illustrated as being used to connect the second end 86 of resilient member 82 to cross brace 49, any other type of connector or fastener may be used.

Although the resilient members 74 and 82 are illustrated as being tension springs, they may alternatively be rubber bands, pieces of elastic or any other resilient member which, when subject to tension, will elongate and then return to its original position once the tension has been removed. Although FIGS. 1–3 illustrate only one resilient member holding each generally U-shaped cross brace into an upwardly raised position, two resilient members, one on each end, may be used to secure the generally U-shaped cross braces 45, 49 in an upwardly raised position.

As seen in FIG. 3, the resilient members 74, 82 bias the generally U-shaped cross braces 45, 49, and particularly the connecting sections 58, 68 of the cross braces, toward one another. When a person sits or lays on the deck of fabric 48 (see FIG. 1) between the connecting sections 58, 68 of the generally U-shaped cross braces 45, 49, the cross braces 45, 49 may pivot downwardly if enough downwardly directed force is applied. Generally U-shaped cross brace 45 will move in the direction of arrow S9. Similarly, generally U-shaped cross brace 49 will move in the direction of arrow 92 from a raised position to a downward lowered position. The deck of fabric 48 will move downwardly in the direction of arrows 91. Thus, when a person is laying on the bed, the frame sections being extended, the generally U-shaped cross braces 45, 49 will pivot downwardly only as far as necessary. The cross braces will not reach their lower most position unless an exceedingly heavy load is placed on the deck 48.

Figure 4:
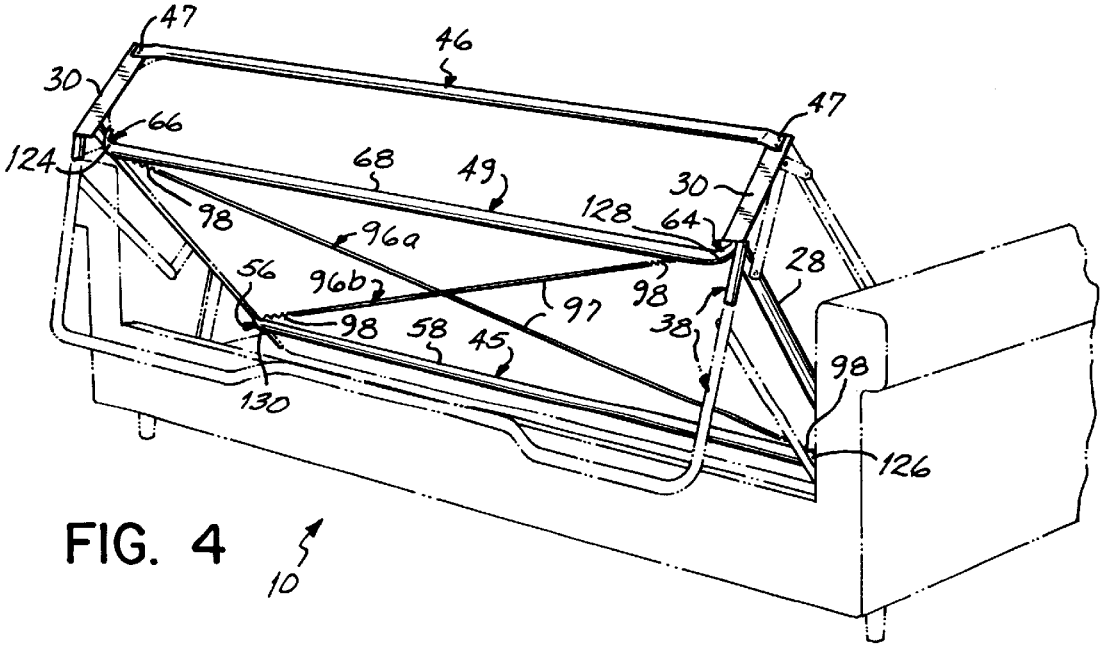
FIG. 4 is a view like FIG. 2 illustrating a pair of resilient members having an "X"-shaped pattern extending between a pair of generally U-shaped cross braces.
Figure 5:
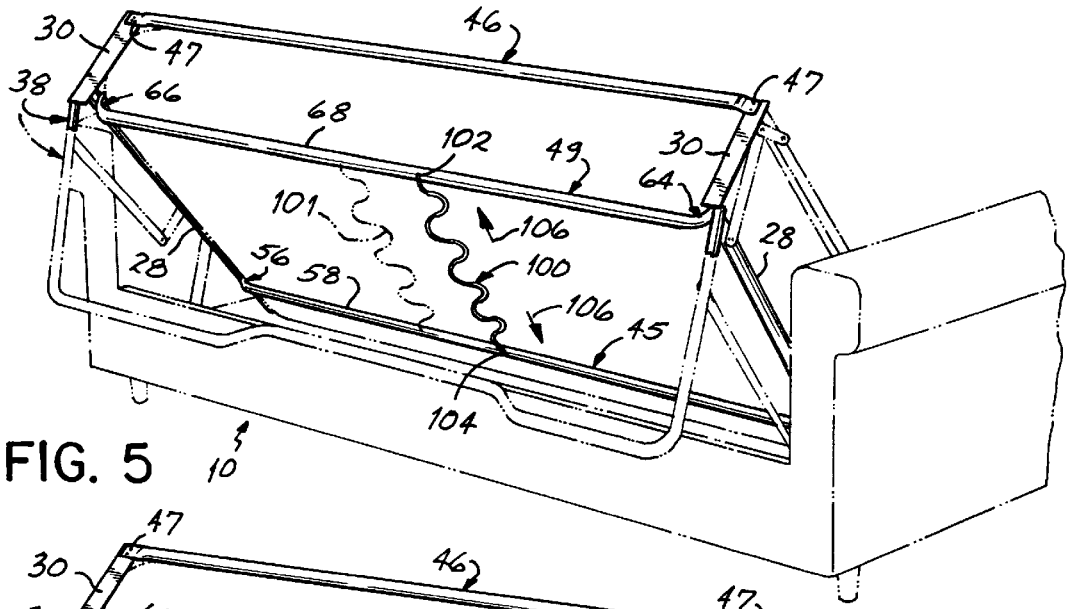
FIG. 5 is a view like FIG. 4 illustrating sinuous wires extending between a pair of generally U-shaped cross braces.
Figure 6:
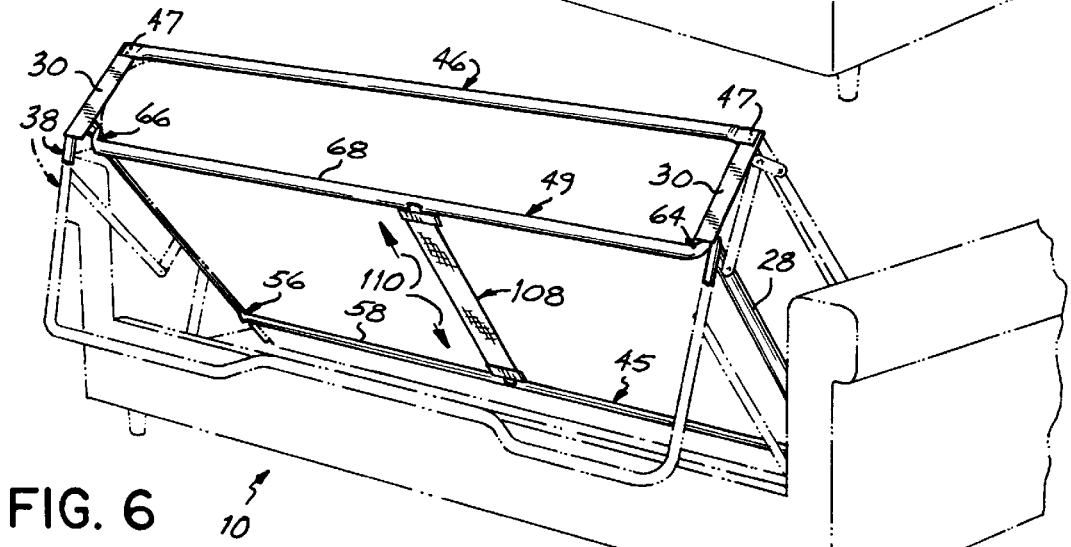
FIG. 6 is a view like FIG. 5 illustrating one elastic strap extending between a pair of generally U-shaped cross braces.

Referring now to FIGS. 4–6, different embodiments of the present invention utilizing different forms of resilient members are illustrated. In each of these embodiments, at least one resilient member tends to urge the pair of generally U-shaped cross braces 45, 49 into their raised position.

Referring to FIG. 4, the sofa bed assembly is illustrated as being in a partially retracted collapsed position similar to FIG. 2, with the foot section being above the body section. A pair of resilient members 96*a*, 96*b* are connected to and extend between the generally U-shaped cross braces 45, 49, The resilient members 96*a*, 96*b* may be strands of wire 97 with tension springs 98 at the ends thereof or, alternatively, may be elastic bands or any other type of member which tends to lengthen upon being placed in tension and return to its original position when the tension is relaxed.

As illustrated in FIG. 4, resilient member 96*a* extends from the left-hand corner 124 of the cross brace 49 downwardly and across to the right-hand corner 126 of generally U-shaped cross brace 45. Similarly, cross brace 96*b* extends from the right-hand corner 128 of cross brace 49 to the left-hand corner 130 of cross brace 45 so that the two resilient members 96*a*, 96*b* form an X-shaped pattern or configuration.

Referring now to FIG. 5, there is illustrated at least one sinuous wire 100 extending between the generally U-shaped cross braces 45, 49. Each sinuous wire extends longitudinally. If multiple sinuous wires are used, they are transversely spaced apart from one another (see sinuous wires 100 and 101). Although only two are illustrated, any number of sinuous wires may be used. Each sinuous wire 100 has a first substantially planar hook 102 at one end and a substantially planar hook 104 at the other end. Substantially planar hook 102 is secured into a hole in the connecting section 68 of cross brace 49. Similarly, second substantially planar hook 104 is secured to the connecting section 58 of U-shaped cross brace 45. The sinuous wires 100 tend to pull the connecting sections 58, 68 of the U-shaped cross braces 45, 49 toward one another into their raised position. When a user lays on the mattress or sits on the sofa seat cushions when the sofa bed assembly is in a retracted position, the sinuous wires 100 tend to stretch longitudinally urging the connecting sections 58, 68 of the generally U-shaped cross braces 45, 49 apart from one another in the direction illustrated by the arrows 106 in FIG. 5 and downwardly. Once the load is removed, the inherent resiliency of the sinuous wires 100 tends to bring the connecting sections 58, 68 of the cross braces 45, 49 towards one another to their at rest position.

Referring now to FIG. 6, in place of sinuous wires, an elastic strap 108 may be used to pivotally raise the connecting sections 58, 68 of the cross braces 45, 49 towards one another and raise the generally U-shaped cross braces to an upwardly raised position. When a downwardly directed force is exerted on one or both of the generally U-shaped cross braces 45, 49, the elastic strap 108 will tend to lengthen in the direction of arrows 110. Once the load is removed the elastic strap 108 will return to its original position and the connecting sections 58, 68 of the generally U-shaped cross braces will return to their raised position.

Figure 7:
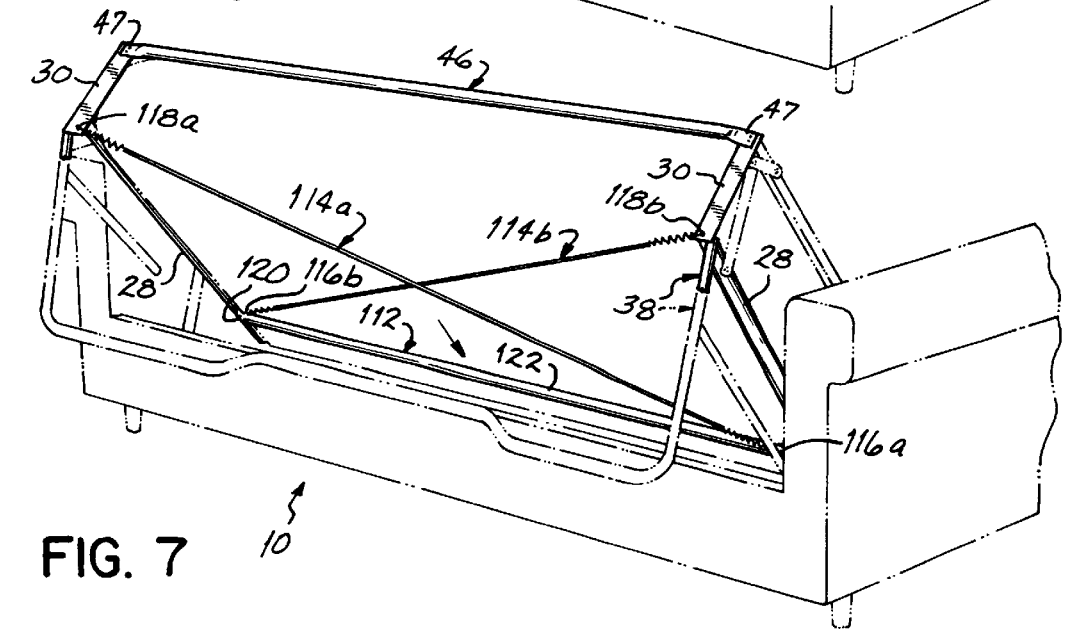
FIG. 7 is a perspective view like FIG. 4, the sofa bed assembly having only one generally U-shaped cross brace, the cross brace being held in an upward raised position by a pair of resilient members in the form of an X.

FIG. 7 illustrates an alternative embodiment of the present invention in which only one generally U-shaped cross brace 112 is utilized. The generally U-shaped cross brace 112 extends between the side rails 28 of the body frame section 18 and is approximately in the same location as the cross brace 45, as illustrated in FIGS. 2–6. The cross brace 112 is pivotally secured to the side rails 28 of the body frame section 18 in the same manner described hereinabove. The generally U-shaped cross brace 112 is configured like the generally U-shaped cross braces 45, 49 in that it has two legs 120 (only one being shown) connected by a connecting section 122.

In this embodiment, a pair of resilient members 114*a*, 114*b* are each connected at one end 116*a*, 116*b* to the connecting section 122 of the cross brace 112. The other ends 118*a,* 118*b* of the resilient members 114*a,* 114*b* are connected to the side rails 30 of the intermediate section 20 of the bed frame. The resilient members 114*a,* 114*b* are illustrated as being identical to the resilient members 96*a,* 96*b* illustrated in FIG. 4 arranged in an X-shaped configuration. However, resilient members 114*a,* 114*b* may be other mechanisms such as elastic straps, rubber bands or any other types of resilient members. The inherent resiliency of the members 114*a,* 114*b* cause the generally U-shaped cross brace 112 to be raised into a raised position as illustrated in FIG. 3.

Thus different resilient members may be used to bias at least one generally U-shaped cross brace into an upwardly raised position in which it does not interfere with the ability of the frame sections to fold into a sofa position. These and other objects and advantages will be apparent to those skilled in the art. Therefore, do not intend to be limited except by the following appended claims.

I claim:

1. A sofa sleeper foldable sofa bed assembly having pivotally interconnected head, body, intermediate and foot frame sections each including a pair of opposed side rails, said foot and head frame sections having end rails connecting said side rails, said frame sections being extendable to form a bed and foldable to form a sofa seat, at least one generally U-shaped cross brace, said at least one generally U-shaped cross brace having two opposed legs interconnected by a connecting section at a first end of each leg of said at least one generally U-shaped cross brace, each leg being pivotally connected at a second end to one of said side rails, said at least one generally U-shaped cross brace being biased by at least one resilient member in an upwardly raised position, said first end of said legs of said at least one generally U-shaped cross brace being movable away from said side rails when a load is placed on said at least one generally U-shaped cross brace.

2. The sofa sleeper foldable sofa bed assembly of claim 1 wherein each resilient member has a first end and a second end, said first end being secured to one of said side rails and said second end being secured to said at least one generally U-shaped cross brace.

3. The sofa sleeper foldable sofa bed assembly of claim 1 wherein said at least one generally U-shaped cross brace is pivotally movable from a first raised position to a second lowered position when said load is placed on said at least one generally U-shaped cross brace.

4. The foldable sofa sleeper sofa bed assembly of claim 1 wherein said at least one resilient member comprises at least one sinuous wire.

5. The foldable sofa sleeper sofa bed assembly of claim 1 wherein said at least one resilient member comprises at least one elastic strap.

6. The foldable sofa sleeper sofa bed assembly of claim 1 wherein said at least one resilient member comprises a pair of resilient members, each resilient member having a first and second end, said first end being connected to said at least one generally U-shaped cross brace and said second end being connected to one of the side rails of the intermediate section of the bed frame.

7. The foldable sofa sleeper sofa bed assembly of claim 1 wherein each resilient member is a spring.

8. A foldable sofa sleeper sofa bed assembly capable of extending from a folded sofa position to an extended bed position, said assembly having a generally rectangular frame comprising pivotally interconnected head, body, intermediate and foot frame sections each including a pair of opposed side rails, end rails connecting said opposed side rails of said head and foot frame sections, respectively, a substantially planar deck connected to said frame, said deck extending transversely between said side rails of said frame and longitudinally between said end rails of said frame, a pair of generally U-shaped cross braces, each generally U-shaped cross brace comprising two opposed legs connected by a connecting section, each leg being pivotally connected to one of said side rails, said generally U-shaped cross brace being pivotally biased upwardly by two resilient members to a raised position in which said connecting section of said generally U-shaped cross brace is located underneath said deck.

9. The foldable sofa sleeper sofa bed assembly of claim 8 wherein each resilient member connects one of said legs of said cross brace to one of said side rails.

10. The foldable sofa sleeper sofa bed assembly of claim 4 wherein said resilient members are springs.

11. A sofa sleeper foldable sofa bed assembly having pivotally interconnected head, body, intermediate and foot frame sections each including a pair of opposed side rails, said foot and head frame sections having end rails connecting said side rails, said frame sections being extendable to form a bed and foldable to form a sofa seat, a pair of generally U-shaped cross braces, each generally U-shaped cross brace comprising two opposed legs connected by a connecting section, each leg being pivotally connected to one of said side rails, said cross braces being pivotally biased upwardly to a raised position by at least one resilient member, said at least one resilient member having two opposed ends, one end of said at least one resilient member being secured to each of said generally U-shaped cross braces.

12. The foldable sofa sleeper sofa bed assembly of claim 11 wherein two resilient members connect said generally U-shaped cross braces.

13. The foldable sofa sleeper sofa bed assembly of claim 11 wherein said generally U-shaped cross braces pivot toward one another.

14. A sofa sleeper foldable sofa bed assembly having pivotally interconnected head, body, intermediate and foot frame sections each including a pair of opposed side rails, said foot and head frame sections having end rails connecting said side rails, said frame sections being extendable to form a bed and foldable to form a sofa seat, said end rails defining a longitudinal dimension of said bed and said side rails defining a transverse dimension of said bed, a pair of U-shaped cross braces, each cross brace comprising two opposed legs connected by a connecting section at a first end of each leg, each leg being pivotally connected to one of said side rails at a second end of said leg, said cross braces being pivotally biased upwardly to a raised position by at least one longitudinally extending sinuous wire spring extending between said cross braces, each sinuous wire spring having a first substantially planar hook at one end of said sinuous wire spring engaged with one of said cross braces and a second substantially planar hook at the other end of said sinuous wire spring engaged with the of said pair of other cross braces.

15. A sofa sleeper foldable sofa bed assembly for supporting a bedding mattress in a flat planar condition when unfolded and for containing a mattress in a folded condition within a sofa sleeper frame when folded, said assembly comprising:

a generally rectangular frame comprising at least a head, a body, and a foot section, said sections being pivotally connected to each other so as to enable said sections to be unfolded into a flat planar condition or folded into a generally U-shaped configuration with said foot section overlying said body section, said foot and head sections of said frame each comprising a pair of side rails interconnected with an end rail, said body section of said frame comprising a pair of side rails, a fabric deck extending transversely between said side rails and longitudinally between said end rails, said fabric deck being secured to said side and end rails, at least one generally U-shaped cross brace, said at least one cross brace having two opposed legs interconnected by a connecting section at a first end of each leg of said at least one cross brace, each leg being pivotally connected at a second end to one of said side rails, said connecting section of said at least one cross brace being biased by at least one resilient member into a raised position, said first end of said legs of said at least one cross brace being movable away from said side rails when a load is placed on said deck.

16. The foldable sofa sleeper sofa bed assembly of claim 15 wherein each resilient member is a spring.

17. The foldable sofa sleeper sofa bed assembly of claim 15 wherein said at least one resilient member comprises two resilient members configured in an X-shaped pattern.

18. The foldable sofa sleeper sofa bed assembly of claim 17 wherein said resilient members are strands of wire with tension springs at the ends of said strands.

* * * * *

UNITED STATES PATENT AND TRADEMARK OFFICE

CERTIFICATE OF CORRECTION

PATENT NO. : 5,903,939
DATED : May 18, 1999
INVENTOR(S) : Dennis Arft

It is certified that error appears in the above-identified patent and that said Letters Patent is hereby corrected as shown below:

Column 1,
Line 19, “bad” should be -- bed --.
Line 51, “bean” should be -- been --.

Column 2,
Line 5, “and” should be -- end --
Line 54, “and” should be -- end --.

Column 3,
Line 7, after “at least” insert -- one --.
Line 18, “and” should be -- end --.
Line 26, “Day” should be -- lay --.

Column 4,
Line 67, “and” should be -- end --.

Column 5,
Line 22, “and” should be -- end --.
Line 37, “bad” should be -- bed --.
Line 58, “15” should be -- 16 --.

Column 6,
Line 5, “and” should be -- end --.
Line 18, “per so” should be -- per se --.
Line 43, “sect-on” should be -- section --

Column 7,
Line 53, “S9” should be -- 90 --

UNITED STATES PATENT AND TRADEMARK OFFICE

CERTIFICATE OF CORRECTION

PATENT NO. : 5,903,939
DATED : May 18, 1999
INVENTOR(S) : Dennis Arft

It is certified that error appears in the above-identified patent and that said Letters Patent is hereby corrected as shown below:

Column 10,
Line 20, the numeral "4" should be -- 8 --.
Line 62, "of said pair of other" should be -- other of said pair of --.

Signed and Sealed this

Second Day of July, 2002

*Attest:*

*Attesting Officer*

JAMES E. ROGAN
*Director of the United States Patent and Trademark Office*